US008424596B2

(12) United States Patent
Bebb

(10) Patent No.: US 8,424,596 B2
(45) Date of Patent: Apr. 23, 2013

(54) HIGH EFFICIENCY FLUID PUMPING APPARATUS AND METHOD

(76) Inventor: Robert Douglas Bebb, Vancouver (CA)

( * ) Notice: Subject to any disclaimer, the term of this patent is extended or adjusted under 35 U.S.C. 154(b) by 364 days.

(21) Appl. No.: 12/917,151

(22) Filed: Nov. 1, 2010

(65) Prior Publication Data

US 2011/0100623 A1 May 5, 2011

Related U.S. Application Data

(60) Provisional application No. 61/257,607, filed on Nov. 3, 2009.

(51) Int. Cl.
*E21B 23/00* (2006.01)

(52) U.S. Cl.
USPC ..... 166/66.4; 166/104; 166/381

(58) Field of Classification Search ..... 166/66.4, 166/104, 250.01, 381
See application file for complete search history.

(56) References Cited

U.S. PATENT DOCUMENTS

| | | | | |
|---|---|---|---|---|
| 6,964,301 | B2 | 11/2005 | Hill et al. | |
| 7,124,819 | B2 | 10/2006 | Ciglenec et al. | |
| 7,260,985 | B2 | 8/2007 | Gilbert et al. | |
| 7,296,462 | B2 | 11/2007 | Gregory et al. | |
| 7,378,769 | B2 | 5/2008 | Head | |
| 7,395,703 | B2 | 7/2008 | Niemeyer et al. | |
| 7,395,879 | B2 | 7/2008 | Segura et al. | |
| 7,417,920 | B2 * | 8/2008 | Hahn et al. | 367/85 |
| 7,428,925 | B2 | 9/2008 | Brown et al. | |
| 7,594,541 | B2 | 9/2009 | Ciglenec et al. | |
| 2005/0284629 | A1 | 12/2005 | Reid et al. | |
| 2006/0266513 | A1 | 11/2006 | Tips | |

FOREIGN PATENT DOCUMENTS

| | | |
|---|---|---|
| CA | 2008152 | 10/1990 |
| GB | 2355033 | 4/2001 |
| WO | WO9708424 | 3/1997 |

* cited by examiner

*Primary Examiner* — Giovanna Wright
*Assistant Examiner* — Catherine Loikith
(74) *Attorney, Agent, or Firm* — Klarquist Sparkman, LLP

(57) ABSTRACT

A high efficiency fluid pumping apparatus and methods having of an electronic motor controller controlling at least one electric motor that is directly coupled to the input of a hollow helical mechanism. The output of the hollow helical mechanism is directly coupled to the shaft of a reciprocating piston pump. Each moving component of the apparatus is designed with a hollow central bore, so that the apparatus assembly will accept a continuous, stationary, hollow conduit containing electrical through wiring and or fiber optics for power and communication to devices physically positioned below the apparatus.

32 Claims, 6 Drawing Sheets

HIGH EFFICIENCY FLUID PUMPING APPARATUS AND METHOD

CROSS REFERENCE TO RELATED APPLICATION

This application claims the benefit of U.S. Provisional Patent Application No. 61/257,607, filed Nov. 3, 2009, which is hereby incorporated by reference.

FIELD

This invention generally relates to the testing and evaluation of underground formations or reservoirs. More particularly, this invention relates to maximizing fluid pumping output capacity in situations where limited electrical power is available downhole and where space is also limited as a result of a need for reduced diameter testing tools.

BACKGROUND

Wells drilled into the ground to recover deposits of oil, gas or other desirable minerals trapped in geological formations often need to be evaluated as to the presence and particular characteristics of those deposits or as to the characteristics of the formations in which those deposits are found. After the presence of such deposits has been confirmed and a portion has been produced, additional evaluations may be performed to determine the quantity and condition of that portion of the original deposit remaining within the geological formation.

One technique for evaluating deposits and formations is to lower an evaluation tool into the well on a wireline. The purpose of some wireline tools is to measure the pressure characteristics of the formation and to retrieve a fluid sample for later analysis in a laboratory. These wireline tools have come to be known as Wireline Formation Testers or WFT's. Other methods of conveyance also exist. The term Drill Stem Testing or DST is frequently used when drill pipe or coiled tubing is used to convey the formation test tool into the well. WFT's and DST's may employ pumps to withdraw fluids from the formation or to inject fluids into the formation.

WFT's can be conveyed on a variety of different types of wireline with some standards for wireline sizes and for the number of electrical conductors having developed within the industry. Wireline sizes typically vary from 0.100 inches to 0.520 inches outer diameter, containing between 1 and 7 internal conductors. Normally two layers of external steel armour surround the conductors to provide protection and strength.

Wireline design options are constrained in several respects. The wireline must be able to fit on a spool that is capable of being mounted on a truck or on a portable skid unit. The spool itself must accommodate a sufficient length of wireline to reach the bottom of deep wells. Together, these two requirements determine a maximum possible diameter for a continuous portable wireline of any given length.

Another requirement is that the wireline must be strong enough to support its own weight, in addition to the weight of the tools to be conveyed plus an allowance for over pull in the event that the tools become subjected to frictional sticking forces. This requirement works to increase the amount of steel armour and therefore to decrease the amount of space available for the internal electrical conductors and insulating materials.

Another requirement is for high voltage ratings between the conductors and ground, as well as between the conductors themselves, if a plurality of conductors is desired. This requirement tends to increase the thickness of the insulating material that surrounds the conductors, further decreasing the amount of space available for the conducting material. Finally, the current carrying capacity of wireline increases with the diameter of the conducting material and electrical power is the product of voltage times current.

When considered together, the aforementioned design requirements all work to place an upper limit on the amount of power that can be conveyed downhole via a portable wireline. Because power downhole is necessarily in limited supply, it is prudent to make the most efficient possible use of that power which is available, particularly in those instances where the wireline tool is expected to perform mechanical work.

Conventional wirelines were first developed before the existence of WFT's and at a time when electronic technology was not in the advanced state it is today. The 7-conductor (heptacable) wireline which has become fairly standard for openhole wireline operations provided early tool designers with a plurality of signal pathways that enabled several measurements to be transmitted to the surface concurrently. Today, the need for multiple signal pathways is reduced or eliminated by the use of telemetry communications between the downhole tools and the surface equipment.

First generation WFT's did not provide for direct continuous pumping of formation fluids or of borehole fluids. Pressure drawdown measurements were made indirectly using pressurized hydraulic fluid to drive pre-test pistons moving within chambers or test-volumes. Continuous pumping capacity was not a design consideration, so that standard heptacable wireline was adequate for the purpose and hydraulic fluid pumping efficiencies were not of great concern.

While some second generation of WFT's tools do provide for direct continuous pumping of formation and of borehole fluids, the use of pressurized hydraulic fluid actuation continues. In these newer tools, the pressurized hydraulic fluid is often employed to actuate reciprocating downhole pumps, commonly referred to as mud-pumps, in addition to actuating pre-test pistons within pre-test volumes.

Hydraulic systems are known to be inherently inefficient. The overall efficiency of a hydraulic system can be calculated as the product of the individual efficiencies of all of the system components. These components necessarily include a hydraulic fluid pump with both mechanical and volumetric losses, in addition to piping, valves and other sources of frictional loss that cause heat generation in the hydraulic fluid. These hydraulic losses further diminish an already limited amount of downhole power that can be delivered to the mud-pump.

A second disadvantage of hydraulic actuation is the lack of ability to directly determine the position of the component being actuated. First generation WFT's employed pre-test designs with fixed volume chambers to address this limitation. Some second generation WFT's employing hydraulic actuation techniques require complex sensing apparatus to determine pre-test volumes or to control mud-pump throughput volumes. Frequently, this lack of ability to accurately control the volume of fluid being pumped has resulted in tool designs that continue to include pre-test volume capabilities, even though this is approach is functionally redundant in combination with a mud-pump.

A third disadvantage of hydraulically actuated mud-pumps is that the best commercially available axial piston pumps to pressurize hydraulic fluid do not provide adequate output volumes in the small diameter sizes that would be required to manufacture a high mud-pump capacity WFT of a small enough diameter to be suitable for slim boreholes. In this case it is hydraulic fluid output capacity that may become the overall limiting design constraint.

A fourth disadvantage of hydraulically actuated mud-pumps is that inherent design difficulties exist in routing power and communication links through the electric motor and hydraulic pump sub-assembly. While hollow-shafted electric motors are commercially available, hollow bore hydraulic pumps are neither commercially available nor conceptually practical to design. For hydraulically actuated mud-pump designs, this restriction necessitates the routing of power and communication links around the outside of the electric motor and hydraulic pump sub-assembly. This in turn limits the maximum outer diameter of the motor and hydraulic pump sub-assembly, reducing its potential output power, as well as greatly complicating overall assembly and maintenance tasks. While this maximum outer diameter constraint may be mitigated by routing some of the power and communication lines through the motor stator windings rather than around the outside of the motor, such approach introduces additional difficulties due to line cross-talk and transient noise from motor switching, while it further increases assembly and maintenance complexity.

Some of the other limitations of the currently available WFT's are described in the literature. W097/08424 teaches a method of well testing and intervention that combines wireline with coiled tubing to overcome the fluid injection and discharge limitations of conventional WFT's. While the method in W097/08424 might be an effective option, it is complex, costly and time consuming due to the need for large amounts of speciality surface equipment.

A second example of a limitation of existing WFT mud-pumps can be found in U.S. Pat. No. 7,395,703, which teaches the use of a complex system of controls to overcome the limitations of pre-tests that are performed in variable test volumes. U.S. Pat. No. 7,395,703 does not indicate how such pre-testing might be done as part of a continuous, rather than a discrete process.

A third example of a limitation of existing WFT mud-pumps can be found in U.S. Pat. No. 6,964,301, which teaches a method of formation sampling that uses two separate flow pathways. The first flow pathway is used to collect the sample while the second flow pathway, concentric around the first flow pathway at the inlet port, acts as a guard to limit the amount of drilling fluid filtrate entering into the first flow pathway. The intent of this arrangement is to minimize contamination of formation fluid samples. While this scheme might be partially effective, such a complex arrangement would not likely be necessary if a mud-pump of sufficient capacity were employed to ensure adequate cleanup of drilling fluid filtrate in the invaded zone prior to collecting the sample.

A recent patent which discloses formation testing while connected to a pipe string, instead of a wireline, is U.S. Pat. No. 7,594,541 (Ciglenec et al) entitled "Pump Control for Formation Testing".

What is still needed, therefore, are simple downhole pumping techniques which make optimum use of the limited amount of power that can be supplied over wireline cables, while providing higher capacity output with pumping characteristics that are inherently useful for WFT's and that are designed in ways that make them amenable to deployment in smaller diameter formation test tools.

SUMMARY

There is provided a high efficiency fluid pumping apparatus and methods having of an electronic motor controller controlling at least one electric motor that is directly coupled to the input of a hollow helical mechanism. The output of the hollow helical mechanism is directly coupled to the shaft of a reciprocating piston pump. Each moving component of the apparatus is designed with a hollow central bore, so that the apparatus assembly will accept a continuous, stationary, hollow conduit containing electrical through wiring and or fibre optics for power and communication to devices physically positioned below the apparatus. Check valves are provided to allow for pump intake and exhaust strokes and a 4-way valve is provided to permit the sources of the pump intake and exhaust to be reversed.

In some embodiments the invention relates to a wireline formation test tool that includes a high efficiency downhole fluid pump. The wireline formation tester may be of a small diameter such as 3⅜" outer diameter, or even smaller.

BRIEF DESCRIPTION OF THE DRAWINGS

These and other features will become more apparent from the following description in which reference is made to the appended drawings. These drawings are for the purpose of illustration only and are not intended to be in any way limiting, wherein.

DETAILED DESCRIPTION

In one or more embodiments, the invention relates to a high efficiency fluid pump that may be used in a downhole tool for formation evaluation or for well stimulation purposes. In some embodiments, the invention relates to methods for using a high efficiency fluid pump. In one or more embodiments, the invention relates to a wireline formation evaluation tool that includes a high efficiency fluid pump. The invention will now be described with reference to FIG. 1 through FIG. 7

Figure 1:
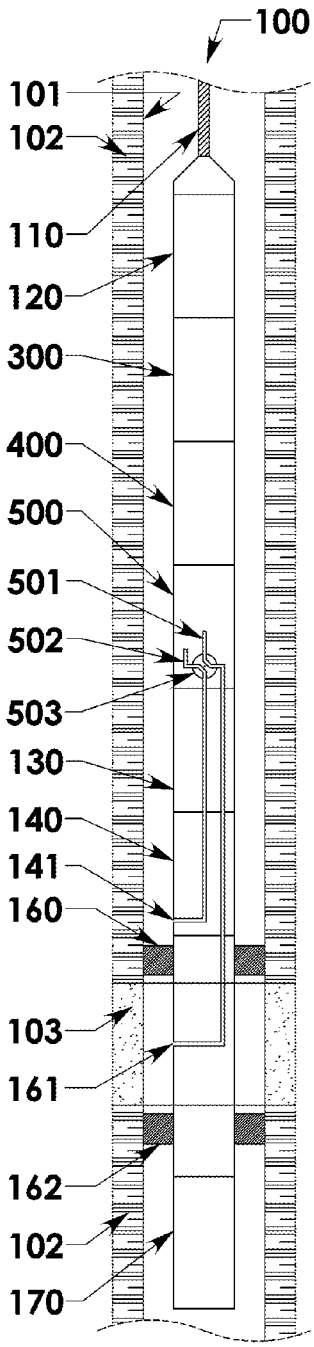
FIG. 1 is a schematic cross-sectional view of one embodiment of a wireline formation test tool in which the present invention may be used.

Structure and Relationship of Parts:

FIG. 1 shows one embodiment of the invention that relates to a wireline formation evaluation tool 100 that includes a high efficiency fluid pump. A borehole 101 is shown to have penetrated two impermeable geological formations 102, in addition to a permeable geological formation 103. In order to evaluate the reservoir characteristics of the permeable formation 103, the wireline formation evaluation tool 100 is conveyed into borehole 101, via wireline 110, so that an upper hydraulic isolation packer 160 is positioned above the permeable formation 103 and a lower hydraulic isolation packer 162 is positioned below the permeable formation 103. The spacing between the upper and lower packers may vary. The packers are shown in their activated position, where their sealing elements have been brought into contact with the borehole wall, in order to provide fluid isolation of the interval of the borehole between the packers.

Figure 3A:
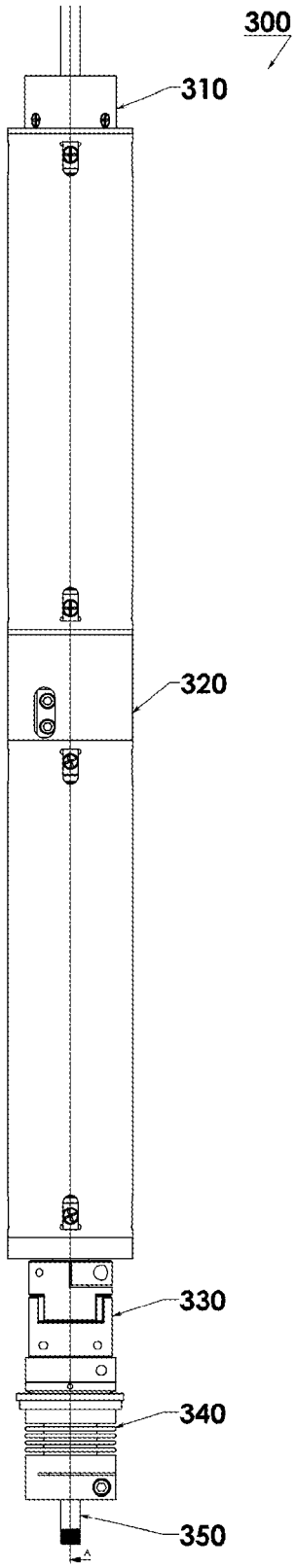
FIG. 3*a* is a is a schematic view of the electric motor section 300 of the embodiments of the wireline formation test tools of FIG. 1 and FIG. 2.
Figure 3B:
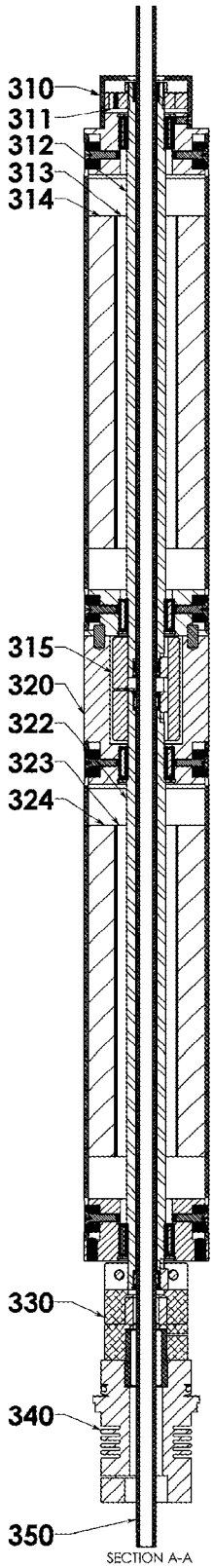
FIG. 3*b* is a schematic cross-sectional view of the electric motor section 300 of the embodiments of the wireline formation test tools of FIG. 1 and FIG. 2.
Figure 4A:
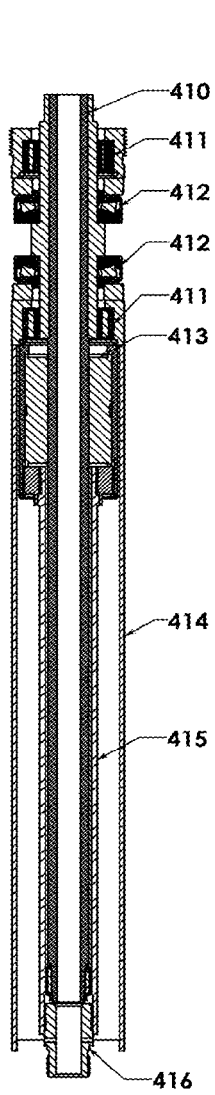
FIG. 4*a* is a schematic cross-sectional view of the hollow helical mechanism section 400 of the embodiments of the wireline formation test tools of FIG. 1 and FIG. 2, shown at the upper limit of the range of its travel.
Figure 4B:
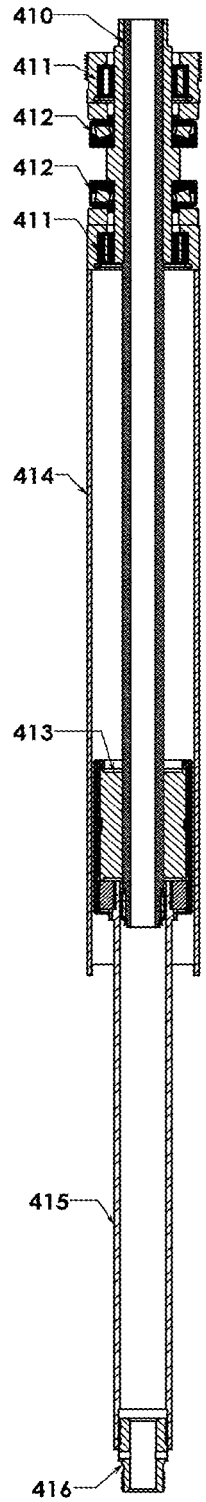
FIG. 4*b* is a schematic cross-sectional view of the hollow helical mechanism section 400 of the embodiments of the wireline formation test tools of FIG. 1 and FIG. 2, shown at the lower limit of the range of its travel.
Figure 5A:
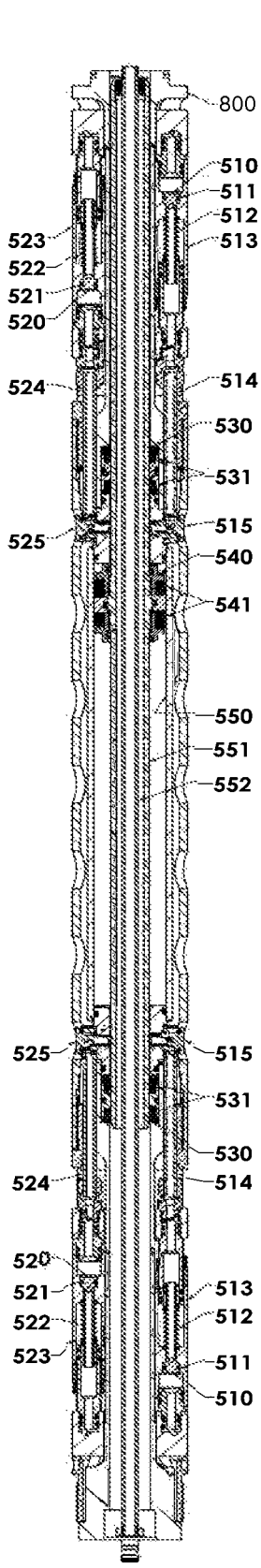
FIG. 5*a* is a schematic cross-sectional view of the reciprocating piston pump section 500 of the embodiments of the wireline formation test tools of FIG. 1 and FIG. 2, shown at the upper limit of the range of its travel.
Figure 5B:
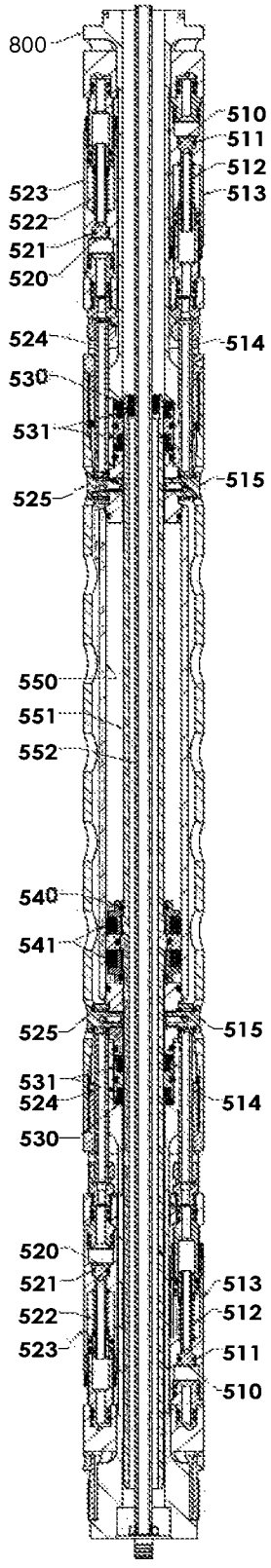
FIG. 5*b* is a schematic cross-sectional view of the reciprocating piston pump section 500 of the embodiments of the wireline formation test tools of FIG. 1 and FIG. 2, shown at the lower limit of the range of its travel.

The wireline formation evaluation tool 100 further comprises an electronics section that includes a motor controller 120; an electrical motor section 300 that is more fully described in FIG. 3*a* and FIG. 3*b*; a hollow helical mechanism section 400 that is more fully described in FIG. 4*a* and FIG. 4*b*; a pump section 500 that is more fully described in FIG. 5*a* and FIG. 5*b*; an optional fluid sampling section 130; a fluid property measurement section 140; and an optional well stimulation fluid carrier section 170.

A first internal fluid pathway is connected to a 4-way valve 503 and passes through internal components, devices and valves appropriate to the optional tool configurations being employed. The first internal fluid pathway may be connected to a first external fluid port 161, placing it in fluid communication with the isolated interval of borehole between the isolation packers, or in the alternative it may be connected to an internal chamber in the optional fluid sampling section 130 or to an internal chamber in the optional well stimulation fluid carrier section 170. By changing the 4-way valve setting, the first internal fluid pathway can either be connected to the high efficiency fluid pump intake 501 or it can be connected to the high efficiency fluid pump exhaust 502. A second internal fluid pathway is connected to the 4-way valve 503 and passes through internal tool components, devices and valves appropriate to the optional tool configurations being employed. The second internal fluid pathway may be connected to a second external fluid port 141, placing it in fluid communication with the borehole annulus above upper hydraulic isolation packer 160, or in the alternative it may be connected to an internal chamber in the optional fluid sampling section 130 or to an internal chamber in the optional well stimulation fluid carrier section 170. Construction of the 4-way valve 503 is such that the second internal fluid pathway is connected to either the high efficiency fluid pump intake 501 or to the high efficiency fluid pump exhaust 502, but in a manner opposite to that of the first internal fluid pathway.

Figure 2:
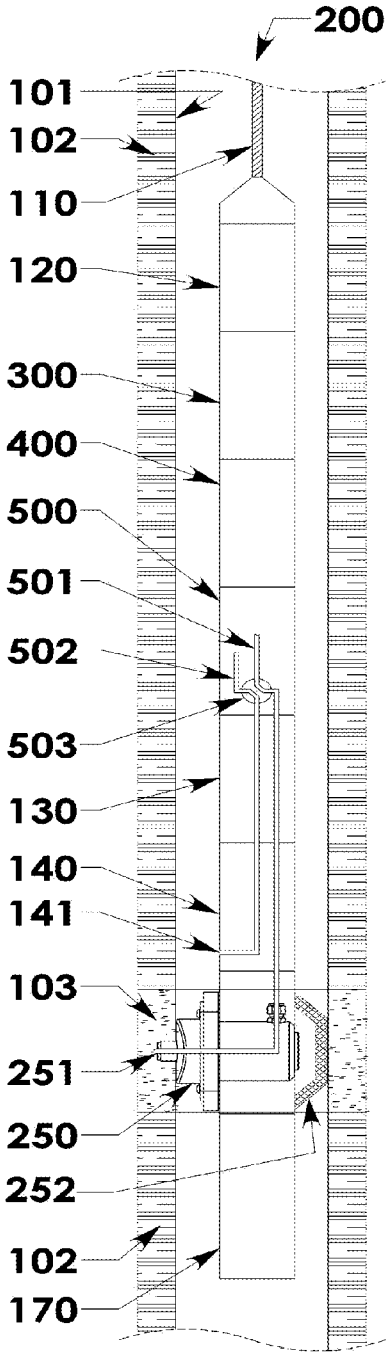
FIG. 2 is a schematic cross-sectional view of an alternative embodiment of a wireline formation test tool in which the present invention may be used.

FIG. 2 shows an alternative embodiment of the invention that relates to a wireline formation evaluation tool 200 that includes a high efficiency fluid pump. A borehole 101 is shown to have penetrated two impermeable geological formations 102, in addition to a permeable geological formation 103. In order to evaluate the reservoir characteristics of the permeable formation 103, a wireline formation evaluation tool 200 is conveyed into borehole 101, via wireline 110, so that a probe 250 is positioned at a point within the interval of the permeable formation 103.

The probe is shown in its extended position, where the sealing element has been brought into contact with the borehole wall, in order to provide fluid isolation of a small, essentially circular area of the borehole. The probe 250 is held firmly against the wall of the borehole by a backup arm or similar device 252, also shown in the extended position.

The wireline formation evaluation tool 200 further comprises an electronics section that includes a motor controller 120; an electrical motor section 300 that is more fully described in FIG. 3*a* and FIG. 3*b*; a hollow helical mechanism section 400 that is more fully described in FIG. 4*a* and FIG. 4*b*; a pump section 500 that is more fully described in FIG. 5*a* and FIG. 5*b*; an optional fluid sampling section 130; a fluid property measurement section 140; and an optional well stimulation fluid carrier section 170.

A first internal fluid pathway is connected to a 4-way valve 503 and passes through internal components, devices and valves appropriate to the optional tool configurations being employed. The first internal fluid pathway may be connected to a first external fluid port 251, placing it in fluid communication with the isolated interval of borehole at the tip of the probe 250, or in the alternative it may be connected to an internal chamber in the optional fluid sampling section 130 or to an internal chamber in the optional well stimulation fluid carrier section 170. By changing the 4-way valve setting, the first internal fluid pathway can either be connected to the high efficiency fluid pump intake 501 or it can be connected to the high efficiency fluid pump exhaust 502. A second internal fluid pathway is connected to the 4-way valve 503 and passes through internal tool components, devices and valves appropriate to the optional tool configurations being employed. The second internal fluid pathway may be connected to a second external fluid port 141, placing it in fluid communication with the borehole annulus, or in the alternative it may be connected to an internal chamber in the optional fluid sampling section 130 or to an internal chamber in the optional well stimulation fluid carrier section 170. Construction of the 4-way valve 503 is such that the second internal fluid pathway is connected to either the high efficiency fluid pump intake 501 or to the high efficiency fluid pump exhaust 502, but in a manner opposite to that of the first internal fluid pathway.

FIG. 3*a* is a schematic view of one embodiment of an electrical motor section 300. FIG. 3*b* is a corresponding schematic cross-sectional view of the same embodiment of an electrical motor section 300. Other embodiments comprising at least one electrical motor are possible. Referring to FIG. 3*b*, an upper electrical motor 310 is comprised of a hollow motor shaft 312, a permanent magnet rotor 313 and an electrically wound stator 314. Similarly, a lower electrical motor 320 is comprised of a hollow motor shaft 322, a permanent magnet rotor 323 and an electrically wound stator 324. The upper hollow motor shaft 312 is mechanically coupled to the lower hollow motor shaft 322 by a hollow shaft coupler 315. The mechanical output of the electrical motor section 300 is coupled to a hollow helical mechanism section 400 that is more fully described in FIG. 4*a* and FIG. 4*b*, via a hollow shaft spider-coupler 330 and a hollow détente-ball torque limiter 340. A hollow tubular conduit 350 is provided for electrical wiring and fibre optic connections of any devices positioned below the electrical motor section 300. Construction of electrical motor section 300 is such that a single rotational position resolver 311 is able to provide rotational position feedback for both the upper electrical motor 310 and the lower electrical motor 320. It will be recognized by those skilled in the art that this control arrangement can be easily extended to control a plurality of motors.

FIG. 4*a* is a schematic cross-sectional view of an embodiment of a hollow helical mechanism section 400, shown at the upper limit of the range of its travel. FIG. 4*b* shows the same embodiment of a hollow helical mechanism section 400 at the lower limit of the range of its travel. A hollow helical screw 410 is held in position by roller bearings 411 and by roller thrust bearings 412. A helical nut assembly 413 is prevented from rotating by guide sleeve 414 but is free to travel along the length of the hollow helical screw 410. The internal central bore of the hollow helical mechanism 400 is designed to accept a hollow tubular conduit containing electrical wiring and fibre optic connections for any devices positioned below the hollow helical mechanism section. A hollow sleeve 415 and a hollow coupler 416 move with the helical nut assembly 413, providing a means for connection to the reciprocating piston pump section that is more fully described in FIG. 5*a* and FIG. 5*b*.

FIG. 5*a* is a schematic cross-sectional view of an embodiment of a reciprocating piston pump section 500, shown at the upper limit of the range of its travel. FIG. 5*b* shows the same embodiment of a reciprocating piston pump section 500, at the lower limit of the range of its travel. Pump body 800 forms a core upon which two intake check valves 523 and two exhaust check valves 513 are mounted. Each intake check valve 523 comprises an intake piston 520, an intake piston seal 521, and an intake return spring 522. Fluid intake is provided via an intake fluid tube 524 and low profile intake elbow 525. Each exhaust check valve 513 comprises an exhaust piston 510, an exhaust piston seal 511, and an exhaust return spring 512. Fluid exhaust is provided via an exhaust fluid tube 514 and low profile exhaust elbow 515. A reciprocating piston shaft 551 is disposed within the bore of a pressure tube 550 and provides a means of mounting for a piston assembly 540 and two opposing piston seals 541. Both ends of the reciprocating piston shaft 551 are constrained to run through seal assemblies 530 and opposing rod seals 531. A hollow tubular conduit 552 is provided for electrical wiring and fibre optic connections of any devices positioned below the reciprocating piston pump section 500.

Figure 6:
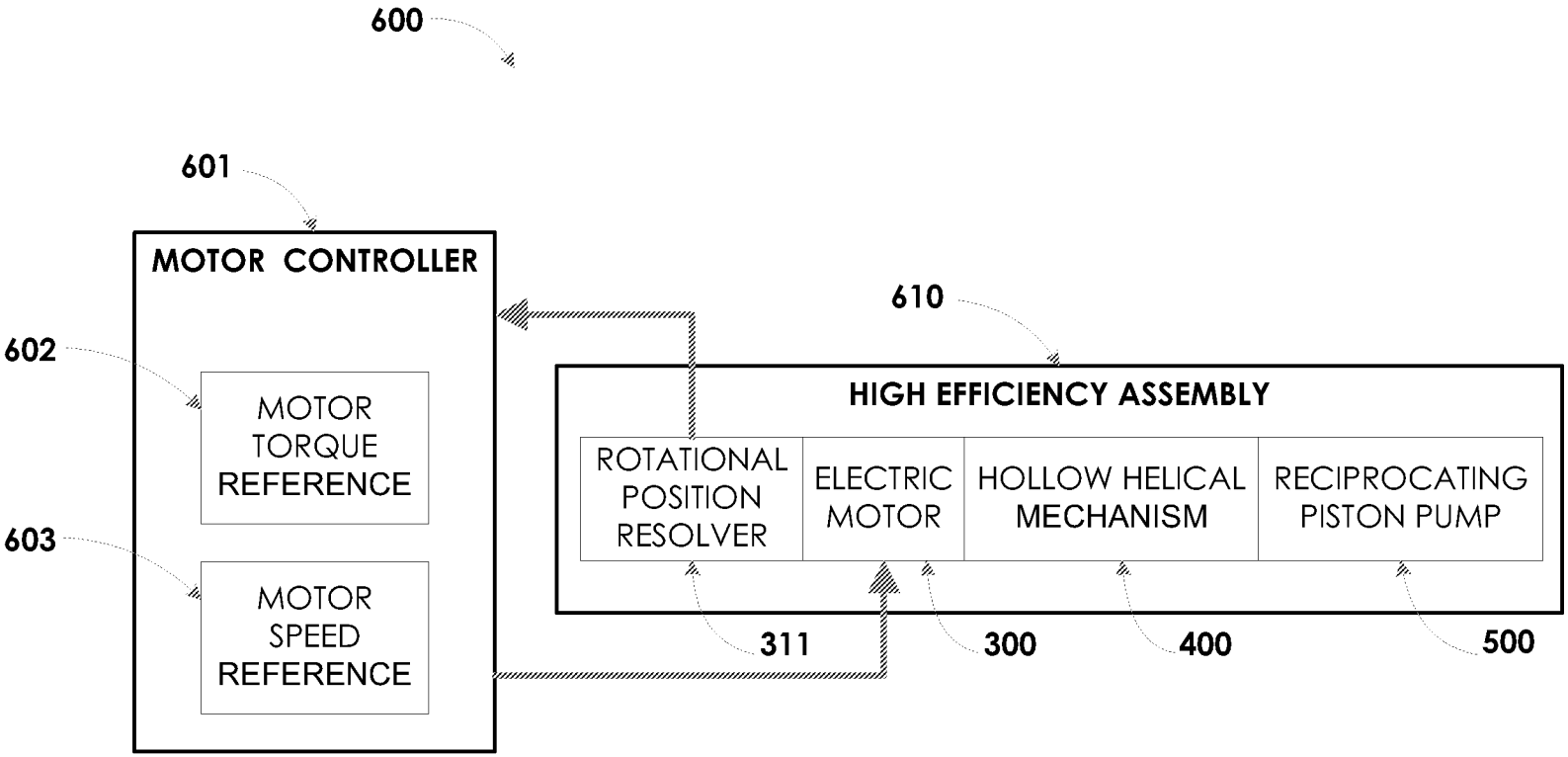
FIG. 6 shows a method in accordance with one embodiment of the invention.

FIG. 6 shows a method for operating a fluid pumping system 600 in accordance with one embodiment of the invention. The method first includes providing a downhole motor controller 601 with a desired motor torque reference value 602 or alternatively with a range of motor torque reference values. Similarly, the method includes providing the downhole motor controller 601 with a desired motor speed reference 603 or alternatively with a range of motor speed reference values. Utilizing the desired values for motor torque and motor speed, in conjunction with motor rotational position data supplied by the rotational position resolver 311, the motor controller adjusts the characteristics of the power supplied to the electric motor section 300. After taking into consideration the individual efficiencies of the electric motor section 300, the hollow helical mechanism section 400, and the reciprocating piston pump section 500, precise control of desired pumping characteristics can be achieved. This arrangement eliminates any need of additional feed-back control loops such as those based on pump output pressure measurement or based on pump piston displacement measurement. In one embodiment, motor torque is held constant by the motor controller 601, while motor speed is controlled within an acceptable range of values. After including calculated allowances for the efficiencies of all components of the high efficiency assembly 610, this method of fluid pump control has the effect of providing control over pump output pressure within the range of the capacity of the pump, and without the need to measure pump output pressure directly. In a second embodiment, motor speed is held constant by the motor controller 601, while motor torque is controlled within an acceptable range of valves. After including calculated allowances for the efficiencies of all components of the high efficiency assembly 610, this method of fluid pump control has the effect of providing control over pump output rate, within the range of the capacity of the pump, and without the need to measure pump output rate directly. In a third embodiment, the electric motor section 300 is first started and then stopped after a desired time interval has elapsed or alternatively after a desired number of motor shaft revolutions has occurred, while both motor torque and motor speed are controlled within desired ranges of values. This method of pump control has the effect of providing control of discrete pump output volumes, at desired output pressures and at desired pump output rates, within the range of the capacity of the pump.

Figure 7A:
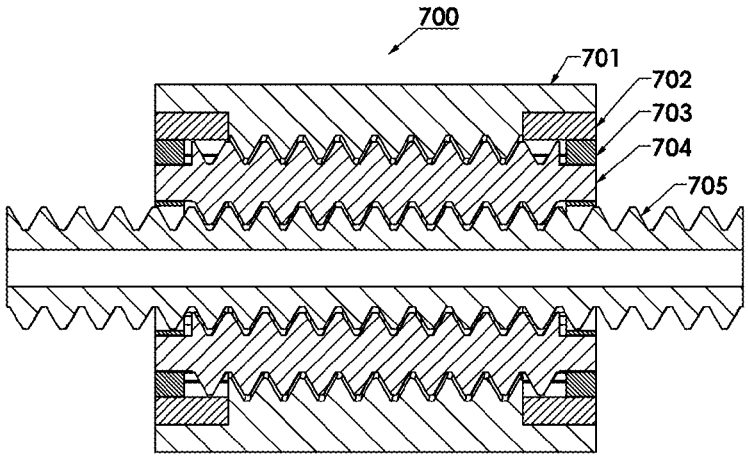
FIG. 7*a* is a schematic cross-sectional view of an embodiment of a planetary roller screw with a hollow central bore.

FIG. 7*a* is a schematic cross-sectional view of an embodiment of a planetary roller screw 700 with a hollow central bore. Planetary roller screws with solid central cores are commercially available. A plurality of roller screws with helical splines on the outer surfaces 704 thereof are disposed between a nut 701 and a lead screw 705 comprising a helical spline on the outer surface thereof. Gear teeth are provided on each end of the roller screws to mate with two ring gears 702 while circumferential spacing of the plurality of roller screws is maintained by two spacer inserts 703.

Figure 7B:
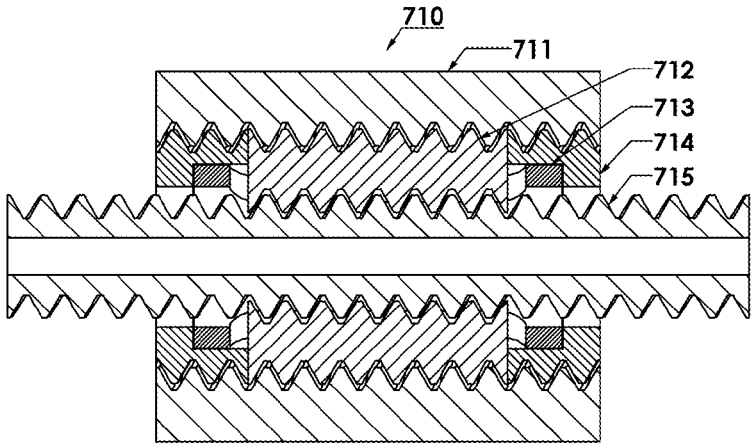
FIG. 7*b* is a schematic cross-sectional view of an embodiment of a recirculating roller screw with a hollow central bore.

FIG. 7*b* is a schematic cross-sectional view of an embodiment of a recirculating roller screw 710 with a hollow central bore. Recirculating roller screws with solid central cores are commercially available. A plurality of roller screws with circumferential grooves on the outer surfaces 712 thereof are disposed between a nut 711 and a lead screw 715 comprising a helical spline on the outer surface thereof. Engagement between the roller screw circumferential grooves and the lead screw helical spline is made possible through the use of even multiples of multi-start threading for the helical spline. Circumferential spacing of the plurality of roller screws is maintained by a roller cage 713 which is held in position by two retainers 714.

Figure 7C:
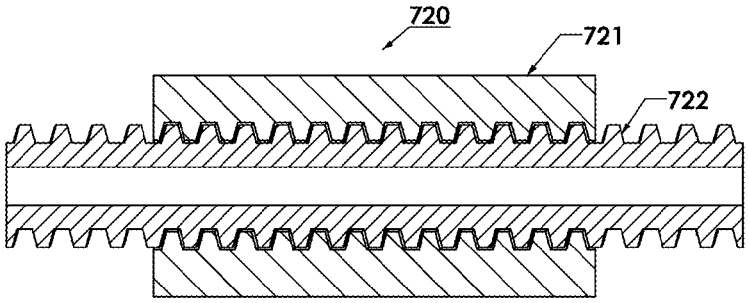
FIG. 7*c* is a schematic cross-sectional view of an embodiment of a lead screw with a hollow central bore.

FIG. 7*c* is a schematic cross-sectional view of an embodiment of a lead screw 720 with a hollow central bore. Lead screws with solid central cores are commercially available. A nut 721 comprising a helical spline on the inner surface thereof is directly engaged with a lead screw 722 comprising a helical spline on the outer surface thereof.

Operation:

Referring now to FIG. 1 and to FIG. 2, in a first embodiment the high efficiency fluid pump intake 501 is brought into fluid communication with a hydraulically isolated area of the geological formation 103 via external fluid port 161, while the high efficiency fluid pump exhaust 502 is brought into fluid communication with the borehole annulus via external fluid port 141. This first embodiment permits fluid to be extracted from the formation 103 and expelled into the borehole annulus while pressure measurements are recorded. In a second embodiment the high efficiency fluid pump intake 501 is brought into fluid communication with the borehole annulus via external fluid port 141, while the high efficiency fluid pump exhaust 502 is brought into fluid communication with a hydraulically isolated area of a geological formation 103 via external fluid port 161. This second embodiment permits borehole fluid to be injected into the formation 103 while pressure measurements are recorded. In a third embodiment the high efficiency fluid pump intake 501 is brought into fluid communication with a hydraulically isolated area of a geological formation 103 via external fluid port 161, while the high efficiency fluid pump exhaust 502 is brought into fluid communication with a sample chamber disposed in the optional fluid sampling section 130. This third embodiment permits fluid to be extracted from the formation 103 and expelled into the sample chamber while pressure measurements are recorded. In a fourth embodiment the high efficiency fluid pump intake 501 is brought into fluid communication with a cushioning fluid contained in a first isolated volume in a fluid sample chamber disposed in the optional fluid sampling section 130, while the high efficiency fluid pump exhaust 502 is brought into fluid communication with the borehole annulus via external fluid port 141. This fourth embodiment permits the cushioning fluid to be extracted from the first isolated volume in the fluid sample chamber while formation fluid is simultaneously drawn into a second isolated volume in the sample chamber that is separated from the first isolated volume by means of a moveable piston. This arrangement permits the collection of formation fluid samples without the risk such formation fluid samples becoming contaminated through direct contact with internal pump components. In a fifth embodiment the high efficiency fluid pump intake 501 is brought into fluid communication with a stimulation fluid contained in a chamber disposed within the optional well stimulation fluid carrier section 170, while the high efficiency fluid pump exhaust 502 is brought into fluid communication with a hydraulically isolated area of a geological formation 103 via external fluid port 161. This fifth embodiment permits stimulation fluid to be injected into the formation 103 while pressure measurements are recorded. In a sixth embodiment the high efficiency fluid pump intake 501 is brought into fluid communication with the borehole annulus via external fluid port 141, while the high efficiency fluid pump exhaust 502 is brought into fluid communication with a first isolated fluid chamber disposed within the optional well stimulation fluid carrier section 170. This sixth embodiment permits borehole fluid to be expelled into the first isolated fluid chamber, while stimulation fluid contained within a second isolated fluid chamber that is separated from the first isolated volume by means of a moveable piston is simultaneously injected into the hydraulically isolated area of a geological formation 103. This arrangement permits the handling of corrosive stimulation fluids such as acids without such corrosive fluids coming into direct contact with internal pump components.

In all embodiments, the desired pumping parameters are determined and appropriate reference values or ranges of values for motor torque 602 and for motor speed 603 are calculated and transmitted by telemetry link to the downhole motor controller 601. The downhole motor controller 601 may use a commercially available method of motor control such as "Field Oriented Control" or "Flux Vector Control" to regulate both motor torque and motor speed independently. After an acknowledgment that the reference values have been received by the motor controller 601 a command is sent to start the motor section 300. On motor start up, the initial direction for motor rotation is determined by the position of the reciprocating piston assembly 540 in relation to the limits of its travel, and is selected to be the greater of the two available distances. Mechanical power from the output shaft of the motor assembly is transmitted via the spider coupler 330 and the détente ball torque limiter 340 to the lead screw 410 of the hollow helical mechanism 400. The rotating lead screw 410 induces linear motion in the helical nut assembly 413 and consequently transmits this linear motion to the reciprocating piston shaft 551 which is connected to the helical nut assembly 413 by hollow coupler 416. This linear movement of the reciprocating piston shaft 551 causes the piston assembly 540 to move within the bore of the pressure tube 550 resulting in the displacement of fluid. This fluid displacement causes an increase in fluid pressure on one side of the moving piston assembly 540, defeating the exhaust return spring 512 of the exhaust valve 513 located on the higher pressure end of the pump to permit an exhaust of the pressurized fluid. Simultaneously, there is a drop in fluid pressure on the opposite side of the moving piston assembly 540, defeating the intake return spring 522 of the intake valve 523 located on the lower pressure end of the pump to permit an intake of the unpressurized fluid. As a safety precaution against loss of communications, the motor controller 601 will only continue to operate the motor section 300 for a fixed period of time, unless it receives a further command to continue for another fixed period of time. This scheme has the effect of permitting semi-autonomous downhole motor control with a built in failsafe mechanism. Whenever the piston assembly 540 approaches the end of its permitted travel in either direction, the motor controller 601 applies a proprietary algorithm to decelerate motor speed to zero and then to reverse the direction of motor rotation and accelerate once again to the motor reference speed 603 or to the previous speed setting within the permissible range of values. Whenever the direction of travel of the piston assembly 540 changes, both intake check valves 523 and both exhaust check valves 513 change their state, opening or closing as required. As pumping progresses, pertinent data are transmitted from downhole to a surface display that can be viewed by the operator. Adjustments may be made to the motor torque 602 and motor speed 603 reference values by the operator and the new values may be sent downhole to the motor controller 601 in order to fine tune the characteristics of the pumping. At the conclusion of the pumping operation a stop command is sent to the downhole motor controller 601.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A fluid pumping apparatus for a downhole wireline tool, comprising:

a housing having a first end and a second end;

a pressure tube positioned within the housing defining an internal fluid chamber;

a reciprocating shaft that moves axially in the fluid chamber carrying a single piston which moves fluids;

a hollow helical mechanism positioned within the housing that drives the reciprocating shaft;

at least one reversible electric motor rotating the hollow helical mechanism, when the at least one reversible electric motor rotates the hollow helical mechanism in a first rotational direction the reciprocating shaft and piston move in a first axial direction and when the at least one reversible electric motor rotates the hollow helical mechanism in a second rotational direction the reciprocating shaft and piston move in a second axial direction;

a downhole motor controller controlling the at least one reversible electric motor;

a wireline connection for connecting to a wireline which provides power to the at least one reversible electric motor and surface communication with the motor controller;

at least one fluid inlet, at least one fluid outlet and valves which open and close depending upon the direction of movement of the reciprocating shaft to allow fluids into and out of the fluid chamber; and a continuous, stationary, hollow conduit extending through the housing from the first end to the second end, with the hollow conduit extending through a center of the at least one electric motor, the hollow helical mechanism, and the reciprocating shaft to allow connection with devices physically positioned below the second end of the housing.

2. The fluid pumping apparatus of claim 1, wherein the hollow conduit contains electrical wiring.

3. The fluid pumping apparatus of claim 1, wherein the hollow conduit contains fiber optics.

4. The fluid pumping apparatus of claim 1, wherein the hollow helical mechanism includes a hollow planetary roller screw.

5. The fluid pumping apparatus of claim 1, wherein the hollow helical mechanism includes a hollow recirculating roller screw.

6. The fluid pumping apparatus of claim 1, wherein the hollow helical mechanism includes a hollow lead screw.

7. The fluid pumping apparatus of claim 1, wherein the hollow helical mechanism includes a shaft that moves axially in a nut as the nut is rotated.

8. The fluid pumping apparatus of claim 1, wherein the hollow helical mechanism includes a nut that travels axially along a shaft as the shaft is rotated.

9. The fluid pumping apparatus of claim 1, wherein the downhole motor controller includes a field oriented controller.

10. The fluid pumping apparatus of claim 1, wherein the downhole motor controller includes a flux vector controller.

11. The fluid pumping apparatus of claim 1, wherein the valves are check valves.

12. The fluid pumping apparatus of claim 1, wherein the single piston divides the fluid chamber into a first section and a second section, the first section having a first inlet controlled by a first valve and a first outlet controlled by a second valve, the second section have a second inlet controlled by a third valve and a second outlet controlled by a fourth valve, when the reciprocating shaft moves in the first axial direction fluid is drawn through the first inlet and fluid is concurrently expelled through the second outlet, when the reciprocating shaft moves in the second axial direction fluid is drawn through the second inlet and fluid is concurrently expelled through the first outlet.

13. The fluid pumping apparatus of claim 12, wherein the first inlet and the second inlet are coupled to provide a single fluid inlet.

14. The fluid pumping apparatus of claim 12, wherein the first outlet and the second outlet are coupled to provide a single fluid outlet.

15. A method of formation pressure testing using the pumping apparatus of claim 1, comprising:

placing the fluid pumping apparatus into a borehole, such that the at least one fluid inlet of the fluid pumping apparatus is in fluid communication with a hydraulically isolated interval of a formation and the at least one fluid outlet of the fluid pumping apparatus is in fluid communication with the borehole.

16. The method of claim 15, the downhole motor controller maintaining constant a commanded value of torque for the at least one reversible electric motor while the speed of the at least one reversible electric motor is permitted to vary between zero and a commanded upper limit.

17. The method of claim 15, the downhole motor controller maintaining constant a commanded value of speed for the at least one reversible electric motor while the torque of the at least one reversible electric motor is permitted to vary between zero and a commanded upper limit.

18. A method of formation pressure testing using the fluid pumping apparatus of claim 1, comprising:

placing the fluid pumping apparatus into a borehole, such that the at least one fluid inlet of the fluid pumping apparatus is in fluid communication with the borehole and the at least one fluid outlet of the fluid pumping apparatus is in fluid communication with a hydraulically isolated interval of a formation.

19. The method of claim 18, the downhole motor controller maintaining constant a commanded value of torque for the at least one reversible electric motor while the speed of the at least one reversible electric motor is permitted to vary between zero and a commanded upper limit.

20. The method of claim 18, the downhole motor controller maintaining constant a commanded value of speed for the at least one reversible electric motor while the torque of the at least one reversible electric motor is permitted to vary between zero and a commanded upper limit.

21. A method of formation fluid sampling using the fluid pumping apparatus of claim 1, comprising:

placing the fluid pumping apparatus into a borehole, such that the at least one fluid inlet of the fluid pumping apparatus is in fluid communication with a hydraulically isolated interval of a formation and the at least one fluid outlet of the fluid pumping apparatus is in fluid communication with a fluid sample chamber.

22. The method of claim 21, the downhole motor controller maintaining constant a commanded value of torque for the at least one reversible electric motor while the speed of the at least one reversible electric motor is permitted to vary between zero and a commanded upper limit.

23. The method of claim 21, the downhole motor controller maintaining constant a commanded value of speed for the at least one reversible electric motor while the torque of the at least one reversible electric motor is permitted to vary between zero and a commanded upper limit.

24. A method of formation fluid sampling using the fluid pumping apparatus of claim 1, comprising:

placing the fluid pumping apparatus into a borehole, such that the at least one fluid inlet of the fluid pumping apparatus is in fluid communication with a cushioning fluid contained a sample chamber and the at least one fluid outlet of the fluid pumping apparatus is in communication with the borehole.

25. The method of claim 24, the downhole motor controller maintaining constant a commanded value of torque for the at least one reversible electric motor while the speed of the at least one reversible electric motor is permitted to vary between zero and a commanded upper limit.

26. The method of claim 24, the downhole motor controller maintaining constant a commanded value of speed for the at least one reversible electric motor while the torque of the at least one reversible electric motor is permitted to vary between zero and a commanded upper limit.

27. A method of well stimulation using the pumping apparatus of claim 1, comprising:

placing the fluid pumping apparatus into a borehole, such that the at least one fluid inlet of the fluid pumping apparatus is in fluid communication with a stimulation fluid contained in a well stimulation fluid carrier and the at least one fluid outlet of the fluid pumping apparatus is in fluid communication with a hydraulically isolated interval of a formation.

28. The method of claim 27, the downhole motor controller maintaining constant a commanded value of torque for the at least one reversible electric motor while the speed of the at least one reversible electric motor is permitted to vary between zero and a commanded upper limit.

29. The method of claim 27, the downhole motor controller maintaining constant a commanded value of speed for the at least one reversible electric motor while the torque of the at least one reversible electric motor is permitted to vary between zero and a commanded upper limit.

30. A method of well stimulation using the pumping apparatus of claim 1, comprising:

placing the fluid pumping apparatus into a borehole, such that the at least one fluid inlet of the fluid pumping apparatus is in fluid communication with the borehole and the at least one fluid outlet of the fluid pumping apparatus is in fluid communication with a fluid displacement chamber of a well stimulation fluid carrier.

31. The method of claim 30, the downhole motor controller maintaining constant a commanded value of torque for the at least one reversible electric motor while the speed of the at least one reversible electric motor is permitted to vary between zero and a commanded upper limit.

32. The method of claim 30, the downhole motor controller maintaining constant a commanded value of speed for the at least one reversible electric motor while the torque of the at least one reversible electric motor is permitted to vary between zero and a commanded upper limit.

* * * * *